US006390047B1

(12) United States Patent
Mitchell

(10) Patent No.: US 6,390,047 B1
(45) Date of Patent: May 21, 2002

(54) ACTIVATION INTERFACE FOR GENERIC AUTOMATIC ENGINE STARTING DEVICES

(76) Inventor: Vincent R Mitchell, 7531 Raven Ridge Point, San Diego, CA (US) 92126

( * ) Notice: Subject to any disclaimer, the term of this patent is extended or adjusted under 35 U.S.C. 154(b) by 0 days.

(21) Appl. No.: 08/949,104

(22) Filed: Oct. 10, 1997

(51) Int. Cl.[7] ..... F02N 11/08
(52) U.S. Cl. ..... 123/179.3; 307/10.6
(58) Field of Search ..... 123/179.2, 179.3, 123/179.9; 307/10.6

(56) References Cited

U.S. PATENT DOCUMENTS 4,674,454 A * 6/1987 Phairr ..... 123/179.2
4,917,061 A * 4/1990 Nagakura ..... 123/179.2
4,928,778 A * 5/1990 Tin ..... 180/167
5,000,139 A * 3/1991 Wong ..... 123/179.2
5,042,439 A * 8/1991 Tholl et al. ..... 123/179.2
5,054,569 A * 10/1991 Scott et al. ..... 180/167
5,121,102 A * 6/1992 Stricklin ..... 340/521

* cited by examiner

*Primary Examiner*—Tony M. Argenbright
*Assistant Examiner*—Arnold Castro

(57) ABSTRACT

A system to interface the activation of an automatic engine starting device with a temperature threshold switch. The invention integrates a temperature threshold signal input, a run mode signal input, and an ignition key-on signal input operatively connected to a mode control switch circuit whereby the mode control switch circuit generates a mode control output signal if the threshold signal is present, and the run mode signal and the ignition key-on signal are not present. The invention incorporates a pulse switch circuit operatively connected to said timer controlled output signal whereby a one-shot pulse switch output signal is generated upon reception of a timer controlled output signal. The present invention can be used as a temperature safety system for a pet inside the cabin of a vehicle in hot weather conditions, or as a block heater to prevent the engine block of a vehicle from freezing in cold weather conditions.

1 Claim, 2 Drawing Sheets

ACTIVATION INTERFACE FOR GENERIC AUTOMATIC ENGINE STARTING DEVICES

BACKGROUND OF THE INVENTION

Most automobile alarm manufactures or distributors offer in their product line a device that when installed properly can automatically start up a vehicle's engine and maintain electrical circuits necessary to operate vehicle mounted electrical accessories. These devices are typically triggered by an input signal derived from a radio frequency receiver that is either a stand alone device, or exist as part of an automobile alarm system. The automatic starting devices are designed to accept a momentary negative 12–15 VDC of approximately 0.5 seconds to the activation input of the auto start device where reception of such a signal would constitute a valid activation command and cause the auto start device to initiate and maintain the run mode. The run mode will typically remain engaged for a pre determined length of time and upon expiration of that time the device will disengaged the run mode and return to a standby status. If a second signal is issued to the activation input during run mode the device interprets this as a shut down signal and deactivates the current run mode. The shut down feature causes a problem for anyone tying to interface an input to the activation circuit of the auto start module with the output typically associated with a external trigger device that generates a prolonged or latched trigger output. The auto start device will begin the run mode upon reception of a trigger signal to it's activation input, however, if this signal is maintained at the activation input of the auto start device, the auto start device interprets this as a second trigger signal and terminates the run mode. The transformation of the prolonged or latched output from the trigger device into a momentary output by itself gives the trigger a one shot characteristic whereif the trigger device is still in the trigger state after the run time has expired a new pulse could not be generated to reinitiate the run mode. Furthermore if a trigger is issued to the activation input of the auto start device too soon after the run mode has expired, the signal will not be recognized as a valid activation command and the auto start device will not reinitiate the run mode.

Known prior art for automatic engine starting devices can be seen in U.S. Pat. Nos. 5,054,569; 5,042,439; 5,000,139; 4,928,778; 4,674,454; 4,296,334; 4,006,723.

BRIEF SUMMARY OF THE INVENTION

The present invention incorporates circuitry which allows various triggering devices to be used to activate any of the generic auto start devices widely available. This is advantageous not only to but especially for those companies and individuals engaged in selling and installing engine auto start devices by permitting an easy interface to their preferred auto start device and any number of triggering devices including, temperature sensors, timers, and latched switches.

DETAILED DESCRIPTION OF THE INVENTION

Figure 1:
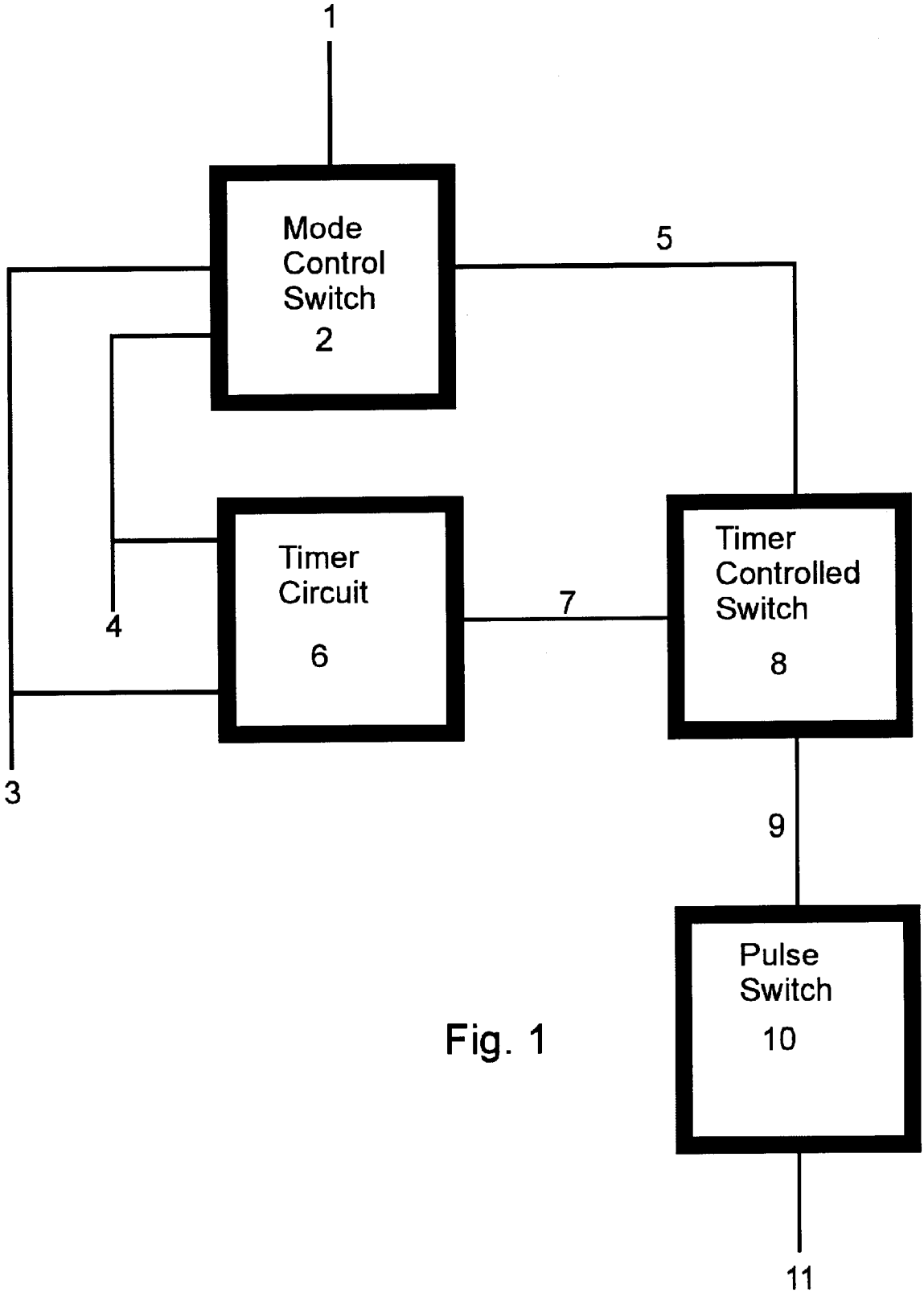
FIG. 1 is a simplified schematic illustration of the present device's connections related to power supply, external triggering device, and generic automatic engine starting device.

Proceeding therefore to describe drawing FIG. 1 in detail, reference should be made to 1 & 2 which represents the connection for the system power supply. It is recommended but not necessary that the system be powered by the vehicle battery because of it's low power consumption. Also in FIG. 1, 3 represents the activation input from a latched, or timed trigger device that is in a normally open or no signal state while said trigger device is in a standby or no trigger state. Upon change of said trigger device to a triggered state said activation input 3 will receive a trigger signal from said trigger device. 4 Represents the run mode input which connects to an output from an auto start device that provides a run mode status. 5 Represents the trigger output from the present invention, to the activation input of an auto start device.

Figure 2:
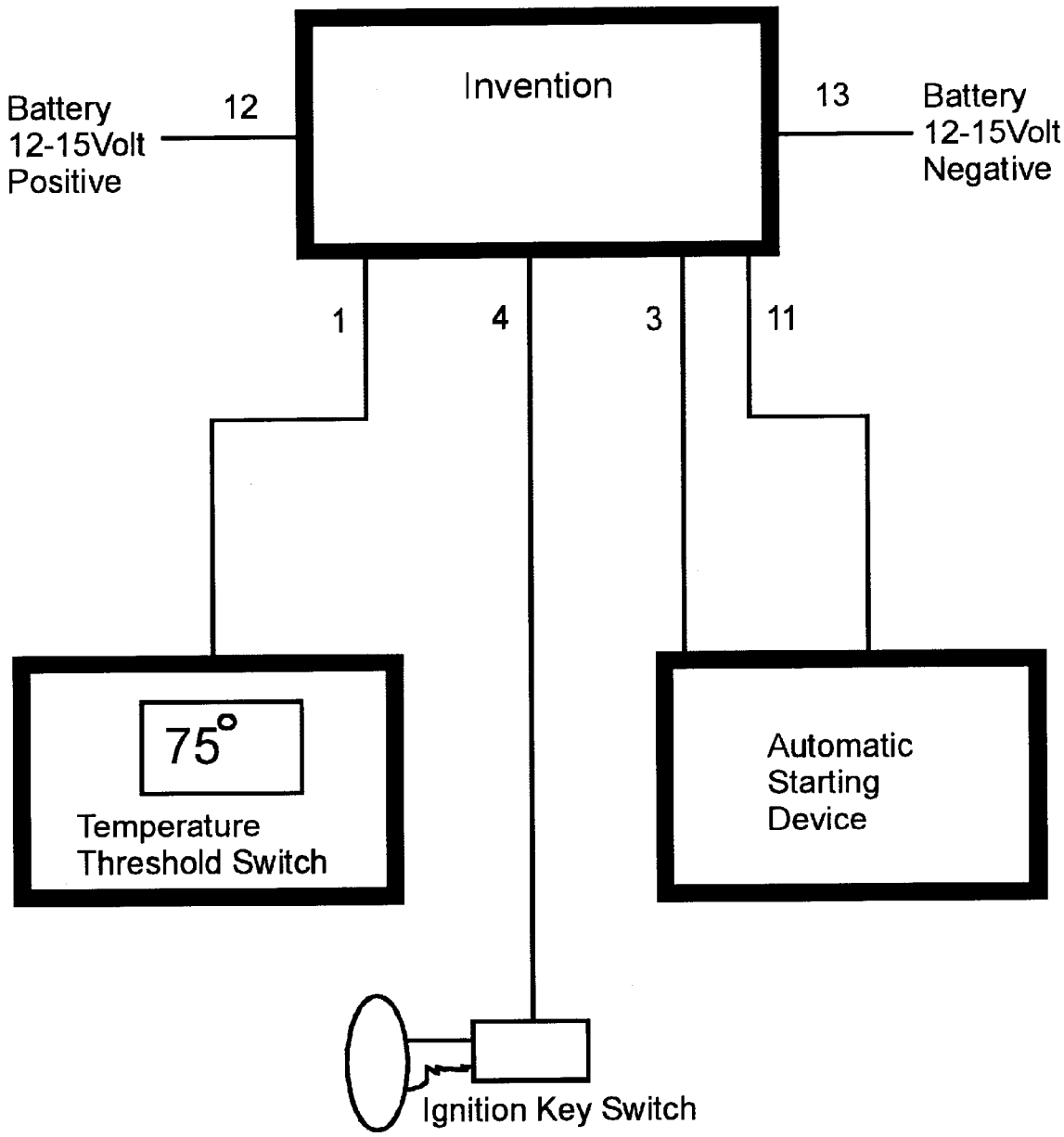
FIG. 2 is a circuit diagram illustrating the logic flow of the present invention.

Proceeding therefore to describe the invention in detail, reference should be made to FIG. 2 in which logic flow of the present can be followed. 1 represents the latched or timed trigger device and it's corresponding trigger state. 2 represents an electric switch connected to the trigger device input and the engine auto start run mode input 3 that creates a control signal 4 only if the trigger device is in trigger state and the engine auto start is not in run mode as determined by input 3. 5 represents an electric switch connected to 3 which creates a control signal 6 upon deactivation of a signal from 3. 7 represents a timer circuit connected to signal 6 which creates a timed output signal 8 of approximately but not necessarily 10 seconds upon reception of signal 4. 9 represents an electric switch connected to 4 and 8 that creates a control signal 10 only if signal 4 is present and signal 8 is not present. 11 represents an electric switch connected to signal 10 that generates a output signal 12 for a duration of approximately 0.5 seconds as to be compatible with the requirements of an auto start device's activation input and has the labeled "output trigger to auto start system".

What is claimed is:

1. A means for controlling signals to trigger the activation circuit of a automatic starting device for an internal combustion engine comprising;

A, a trigger input and a run mode input operatively connected to a switch circuit whereby said switch circuit generates a control signal if said trigger input circuit is in a trigger state and said run mode input is not in a trigger state, and B, a second switch circuit operatively connected to said run mode input whereby said switch circuit generates a second control signal when said run mode input trigger deactivates, and C, a timer circuit operatively connected to said second control signal whereby said timer circuit generates a third control signal for a predetermined length of time, and D, a third switch circuit operatively connected to said first control signal and said third control signal whereby a forth control signal is generated if said first control signal is in a trigger state and said third control signal is not in a trigger state, and E, a forth switch circuit operatively connected to said third control signal whereby an output signal is generated upon reception of said third control signal

* * * * *